United States Patent [19]

Ito et al.

[11] 4,168,901

[45] Sep. 25, 1979

[54] DEVELOPER HOUSING SEALING DEVICE FOR ELECTROPHOTOGRAPHY

[75] Inventors: Yoshio Ito; Katuhiko Yamada; Tadayuki Kitajima, all of Yokohama; Koichi Miyamoto, Tokyo; Hiroo Kobayashi, Tokyo; Yoshikuni Tohyama, Tokyo, all of Japan

[73] Assignee: Canon Kabushiki Kaisha, Tokyo, Japan

[21] Appl. No.: 822,370

[22] Filed: Aug. 5, 1977

Related U.S. Application Data

[63] Continuation of Ser. No. 648,894, Jan. 14, 1976, abandoned.

[30] Foreign Application Priority Data

Jan. 21, 1975 [JP] Japan ..... 50-9057

[51] Int. Cl.[2] ..... G03G 15/00

[52] U.S. Cl. ..... 355/3 DD; 118/653; 118/652; 355/15

[58] Field of Search ..... 355/3 R, 3 DD, 15; 118/652–658

[56] References Cited

U.S. PATENT DOCUMENTS

| | | | |
|---|---|---|---|
| 3,332,328 | 7/1967 | Roth | 118/655 X |
| 3,336,904 | 8/1967 | Obuchi | 118/654 |
| 3,633,544 | 1/1972 | Weiler | 118/654 X |
| 3,685,485 | 8/1972 | Kutsuwada et al. | 355/15 X |
| 3,784,297 | 1/1974 | Ito et al. | 355/15 X |
| 3,791,730 | 2/1974 | Sullivan | 118/637 X |
| 3,809,012 | 5/1974 | Delvecchio | 118/637 |
| 3,906,899 | 9/1975 | Harpavat | 118/637 |
| 3,939,801 | 2/1976 | Tanaka et al. | 118/658 |
| 3,952,701 | 4/1976 | Yamashita | 118/658 |

*Primary Examiner*—R. L. Moses

*Attorney, Agent, or Firm*—Fitzpatrick, Cella, Harper & Scinto

[57] ABSTRACT

This specification discloses a developer treating device for preventing scattering or similar phenomenon of developer in an electrophotographic copying machine. The device is applicable to a developing device, a cleaning device or the like disposed in opposed relationship with the surface of a photosensitive medium to be developed or to be cleaned. In order that the flow of developer may be positively utilized to prevent the same from flowing out of the developing device or the cleaning device, the device has a developer scatter preventing member such as stay or the like which forms a multistage slit between itself and the surface of the photosensitive medium.

14 Claims, 7 Drawing Figures

DEVELOPER HOUSING SEALING DEVICE FOR ELECTROPHOTOGRAPHY

This is a continuation of application Ser. No. 648,894, filed Jan. 14, 1976 now abandoned.

BACKGROUND OF THE INVENTION

1. Field of the Invention

This invention relates to a treating device for preventing scattering or similar phenomenon of developer in an electrophotographic copying machine, and more particularly to a device for preventing scattering of developer in the developing device or the cleaning device of the electrophotographic copying machine.

2. Description of the Prior Art

The developing device of the electrophotographic copying machine, as is well-known, is a device for developing electrostatic latent images formed on a photosensitive medium into visible images by the use of developing dust (toner) or a developer consisting of a suitable mixture of toner and carrier. In such a developing device wherein, for example, developing dust is magnetically attracted to the surface of a developing roller and then applied to the surface of a photosensitive drum, the developing dust tends to be entrained by an air stream resulting from rotation of the photosensitive drum and the developing roller and thereby scattered or suspended into the copying machine through the edge of the opening in the developing device. This may result in contamination of the machine interior by the developing dust, or deposition of the dust on the corona wire of the charger which would cause irregular charging effect, or deposition of the developer dust on transfer paper or the photosensitive drum surface which would deteriorate the quality of the resultant image. The dust deposited on the charger would also result in abnormal discharging thereof which might damage the photosensitive drum surface. Such adverse effects of the scatterd toner are more likely to to occur with a increase in copying speed.

As means for preventing such scattering of developing dust, a device using a suction blower and a dust collecting filter to evacuate and collect the developing dust is known from, for example, Japanese Utility Model Publication No. 48/25136.

The conventional device of this type has encountered not only a problem of arrangement in that the device must be mounted in a limited space within a copying machine, but also problems such as the noise which is continuously made by the device, unavoidable complication and higher cost of the device, and reduced efficiency of dust collection which would arise unless filter replacement is frequently made.

U.S. Pat. No. 2,551,582 discloses prior art which adopts the mist developing on a web-like photoconductor, a series of staggered baffles are provided to shield the path of the mist from the optical section. This device is intended to collect droplets falling against the flow of the mist, and tends to be structurally complicated unlike a mechanism which positively utilizes the flow of developer to prevent scattering of toner or the like. No arrangement has been disclosed as yet in which such baffles are disposed as near the surface of the photosensitive medium as possible and yet maintained at that position.

SUMMARY OF THE INVENTION

It is an object of the present invention to eliminate the above-noted disadvantages peculiar to the prior art and to provide a developer treating device which positively prevents and eliminates scattering of developer by the provision of a developing dust scatter preventing means in an electrophotographic copying machine.

It is another object of the present invention to provide a developer treating device having means for preventing scattering of developing dust mounted in the opening portion whereat a developing device or a cleaning member is mounted in opposed relationship with the region of an electrophotographically photosensitive medium which is to be developed or to be cleaned.

It is still another object of the present invention to provide a developer treating device which positively utilizes the movement of developing dust tending to flow with movement of the photosensitive medium to prevent the developing dust from scattering away to the exterior of various process instruments disposed in the opening portion between the developing device or the cleaning device and the photosensitive medium and in proximity to or in contact with the latter.

It is a further object of the present invention to provide a developer treating device in an electrophotographic copying machine in which the opening portion between the photosensitive medium and various process instruments disposed in proximity to or in frictional contact with the surface of the photosensitive medium is narrowed into a very thin slit form and which does not use rotative or other driving force but efficiently utilizes the air stream resulting from movement of the photosensitive medium to enhance the dust collecting efficiency.

It is a further object of the present invention to provide a developer treating device in which a locating member integrally related to a developing dust scatter preventing member utilizing the air stream disposed in said opening portion is provided to maintain the clearance between the dust scatter preventing member and the photosensitive medium in a very thin slit form, and to keep such scatter preventing member at its retracted position during removal of the photosensitive medium from the machine so as to avoid any damage which would otherwise be imparted to the photosensitive medium by inadvertent contact of the scatter preventing member with the photosensitive medium. The device is thereby made easier to handle due to the integral operation of the dust scatter preventing member and the locating member.

Another feature of the present invention is a developer treating device which is also applicable to high-speed developing devices, for example, those developing devices as disclosed in U.S. Pat. Nos. 3,048,704; 3,145,122; 3,152,924; 3,176,652; 3,455,276; 3,543,720; 3,608,522; 3,724,422, etc. wherein a photosensitive medium, a sleeve of non-magnetic material and a permanent magnet are arranged in the named order so that magnetic developer is supplied into between the photosensitive medium and the sleeve and high-speed development is achieved by relative movement of these three members, and which prevents the scattering of developing dust which is liable to occur during high-speed development.

Other objects and features of the present invention will become fully apparent from the following detailed description thereof taken in conjunction with the accompanying drawings.

DESCRIPTION OF THE PREFERRED EMBODIMENTS

Figure 1:
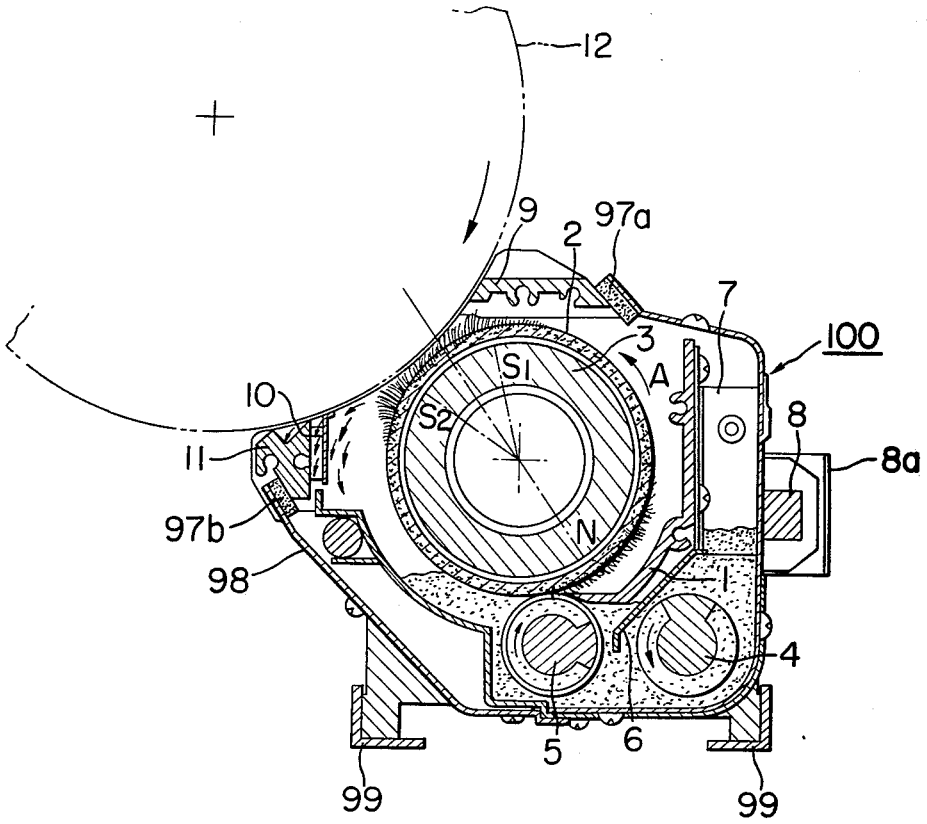
FIG. 1 is a cross-sectional view of an embodiment of the developer treating device according to the present invention as applied to a developing device.

FIG. 1 is a cross-sectional view showing an embodiment of the developer treating device according to the present invention as applied to the developing device of an electrophotographic copying machine. This developing device is of a design which has been advanced from the conventional magnetic brush roller so as to be adapted for high-speed image development but, of course, the developer treating device of the present invention is also applicable to the conventional magnetic brush developing device. The shown construction will first be explained. This high-speed developing device is usually of such a construction that a photosensitive medium, a sleeve of non-magnetic material and a magnet contained within the sleeve are arranged in the named order and developing dust containing a magnetic developer is supplied onto the outer surface of the sleeve to develop an electrostatic latent image on the surface of the photosensitive medium with the aid of the relative rotation of said three members.

A feature of the developing device according to this embodiment is that, in addition to the above-described construction, two magnetic poles of identical polarity are disposed adjacent to the surface of the photosensitive medium to be developed, so as to form repelling fields to thereby create an effect equivalent to a widened developing area (an increased developing time) as well as a magnetically developing effect and a cascade developing effect, thus enabling the developed image to have some edge effect. As a further effect of the repelling fields, the developer in the space surrounded by four walls—the photosensitive medium surface, the sleeve surface and the two magnetic poles of identical polarity—may be very rapidly agitated while developing the photosensitive medium and thus, deposition of always identical developer on the sleeve surface may be avoided without the need to use a scraping blade or the like.

In FIG. 1, the drum-shaped photosensitive medium 12 (partly indicated by dots-and-dash line) is supported for rotation in the direction of the arrow, and a developing device 100 is disposed in opposed relationship with the photosensitive medium, downwardly in the direction of rotation thereof, and arranged for axial movement relative to the drum-shaped photosensitive medium 12. Designated by 99 is a guide member for such axial movement of the developing device. A sleeve 2 of non-magnetic material is opposed to the photosensitive medium 12 and extends axially thereof, and a permanent magnet 3 is embraced by the sleeve. In the shown construction, the sleeve 2 of non-magnetic material is supported for rotation in the direction of arrow A, while the permanent magnet 3 is fixedly secured. Of course, in the ordinary developing system of such type known as the "sleeve developing system", the sleeve and the magnet only have to be movable relative to each other and the relationship described above is merely a preferred mode of practice. The shown permanent magnet has developing poles S1 and S2 of identical polarity somewhat spaced apart and magnetized at points opposed to that region of the photosensitive medium which is to be developed. A magnetic pole N acting to pump up the developer from below is magnetized in the permanent magnet 3 at a point substantially diametrically opposed to the S poles.

Within a housing 98 substantially below the N pole, a screw 5 is disposed along the axis of the sleeve 2 and a further screw 4 for conveying the developer from a developer supply station is disposed in side-by-side relationship with the screw 5. Disposed between the screws 4 and 5 is a chamber partition plate 6 which is discontinued on its way down to the housing 98 so as to provide a communication between the portions below the screws 4 and 5, so that the particles of developer around the screws in these portions coact together.

The developer used with the present embodiment is magnetic materials consisting of magnetic carrier particles such as powdered iron or the like and triboelectrically charged toner particles. Of course, other magnetic materials are used with other types of developing devices and these are also materials which can be prevented from scattering by the device of the present invention.

As viewed in FIG. 1, the developer is conveyed toward the other side by the conveyor screw 4 and conveyed back toward the viewed side by the return screw 5, and replenished with both a fresh supply of developer and toner collected from cleaning means to be described. Thereafter the developer is recycled in the manner described just above.

A knife-edged blade 1 is disposed between the screw 5 and the sleeve 2 to control the quantity of developer pumped up from the screw 5 onto the sleeve 2 by the action of the pole N and by such blade, any greater amount of developer than necessary is scraped to reduce the load torque of the rotating sleeve 2, thus facilitating the high-speed rotation thereof.

In the back of the screw 4, an ATR (automatic toner replenishing) device is accommodated within the housing 98, and an ATR detector element 8 encased in a casing 8*a* is mounted on the outer surface of the housing 98 at a predetermined level. In the back of the partition plate 6, the conveyance force of the screw 4 is set to overcome that of the screw 5 so that the developer may be stagnant in the back of the screw 4, namely, near the ATR device (see FIG. 2), to thereby make the level detection type ATR device operate smoothly.

Figure 2:
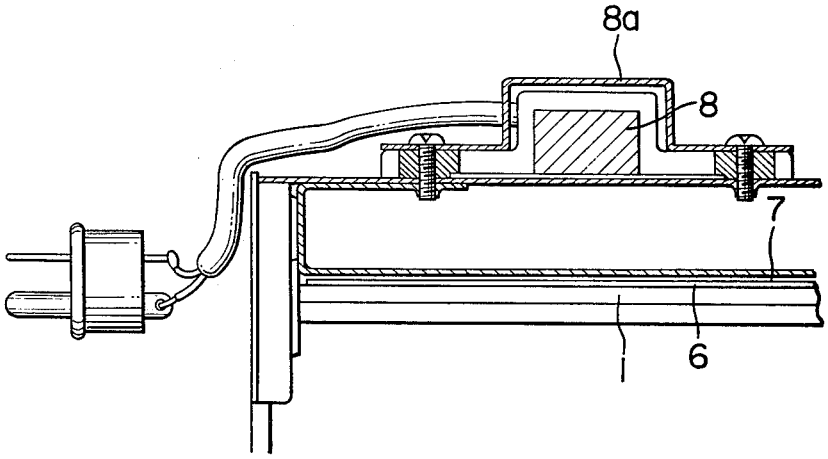
FIG. 2 is a vertical cross-sectional view of an automatic developer concentration detector used in the developing device of FIG. 1.

The level detection type ATR device (automatic concentration regulator) will now be considered. Level detection is equivalent to volume detection and is based on the concept that a constant quantity of developer maintained also means a constant concentration thereof. This is because, in a conventional device within the carrier in the developer consisting of carrier and toner, as described, is always maintained at a constant quantity without being consumed, maintaining the developer at a constant quantity is sufficient to maintain a constant concentration of the developer. When the developer containing powdered iron as a carrier assumes a level lower than the level of the shown ATR element 8, this element detects the variation in the electrostatic capacity or the magnetic field around the element to operate a hopper to supply toner. What is important is the fact that the magnet 3 often lies near the ATR element. This gives rise to the necessity that the magnetic field produced by the magnet be prevented from adversely affecting the element. In other words, the element must be shielded against the magnetic field which will result in disturbance. Shield plates 6, 7 and 8*a* shown in FIGS. 1 and 2 are magnetically shielding walls formed of a magnetic material. These shield plates ensure reliable operation of the ATR of the type used with the present invention which detects variations in electrostatic capacity, permeability, etc.

The developer pumped up by the pole N is regulated to a predetermined thickness of layer on the surface of the sleeve 2 by the blade 1, and then conveyed to the developing zone with the rotation of the sleeve 2 in the direction of the arrow. In the portion of the developing zone (S1–S2) which is just above the poles S1 and S2, the magnetic brush hairs rise up and frictionally contact the surface of the photosensitive medium 12 to be developed, while in the portion of the developing zone which is intermediate between the poles S1 and S2, the intensity of the magnetic force between the non-magnetic sleeve 2 and the photosensitive drum 12 is substantially in the vicinity of zero so that the mutual attraction between the carriers in such portion is weakened, thus permitting a powder cloud condition to be created by the centrifugal force of the rotating sleeve 2 and the repelling fields between the two poles S1 and S2. By the developer in such a condition, the surface to be developed may be developed softly. Consequently, image reproduction with good harmony in tone may be accomplished with fidelity. Such developing device is disclosed in our copending U.S. application Ser. No. 620,402.

Reference will now be made to FIGS. 1, 3(A), 3(B) and 4 to describe the developer scatter preventing means in the above-described developing device and a locating mechanism for retaining the developer scatter preventing means with a predetermined slight clearance with respect to the surface of the photosensitive medium to be developed.

Figure 3A:
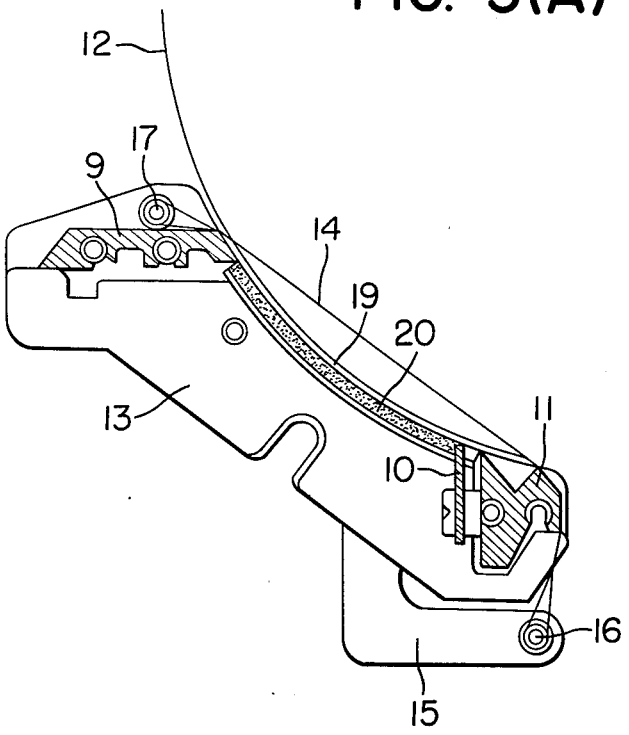
FIG. 3(A) is a cross-sectional view of a dust-proof framework used in the developing device of FIG. 1, and FIG. 3(B) a front view of such framework taken widthwise thereof.
Figure 3B:
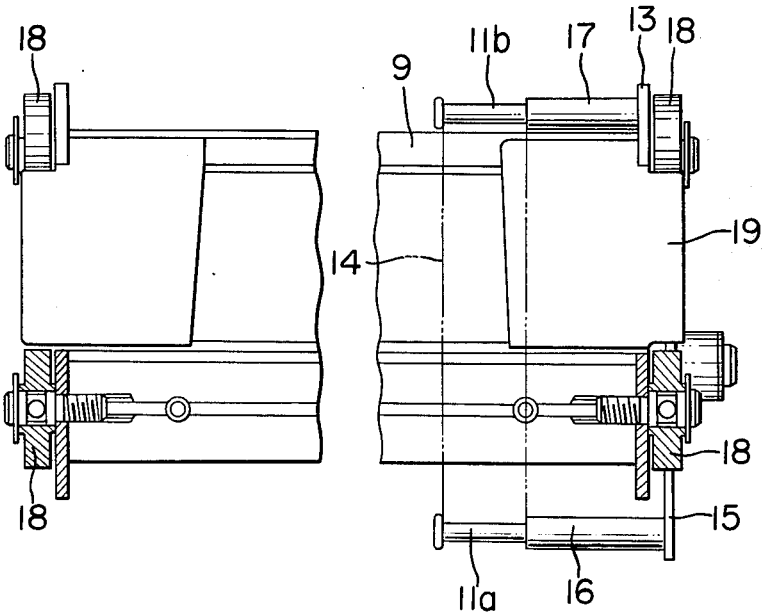

Description will first be made of a dust-proof framework acting as the developer scatter preventing means. An upper stay 9 and lower stays 10 and 11, shown in FIGS. 1 and FIGS. 3(A) and 3(B), are attached to the upper and lower opening portions of the developing device housing 98 by means of resilient members 97*a* and 97*b*, respectively. These stays 9, 10 and 11 extend parallel to the center axis of the photosensitive medium (drum) 12 over the length thereof, keeping a very slight clearance, preferably within a range of 0.6 to 0.05 mm, with respect to the drum 12, and define a very long and very thin slit-like form. At the opposite ends of these stays, there are side plates 13 for supporting the stays, and the stays and the side plates together constitute a fixed framework. Each side plate 13 has a member 14 for sharply restricting the image end portions and members 11*a*, 11*b* for supporting the member 14. The functions of these stays will be described later.

Next, description will be made of the locating mechanism for maintaining the dust-proof framework with the aforesaid predetermined slight clearance retained with respect to the outer surface of the photosensitive drum 12. This mechanism includes spacer rollers 18 provided at four corners of the framework, namely, the corners on the front and the rear side of the framework as viewed in the drawings. These rollers are urged in four-point contact fashion against the outer peripheral surface of the drum 12 at the opposite ends thereof to ensure the clearance between the stays, 9, 10, 11 and the drum surface.

Figure 4:
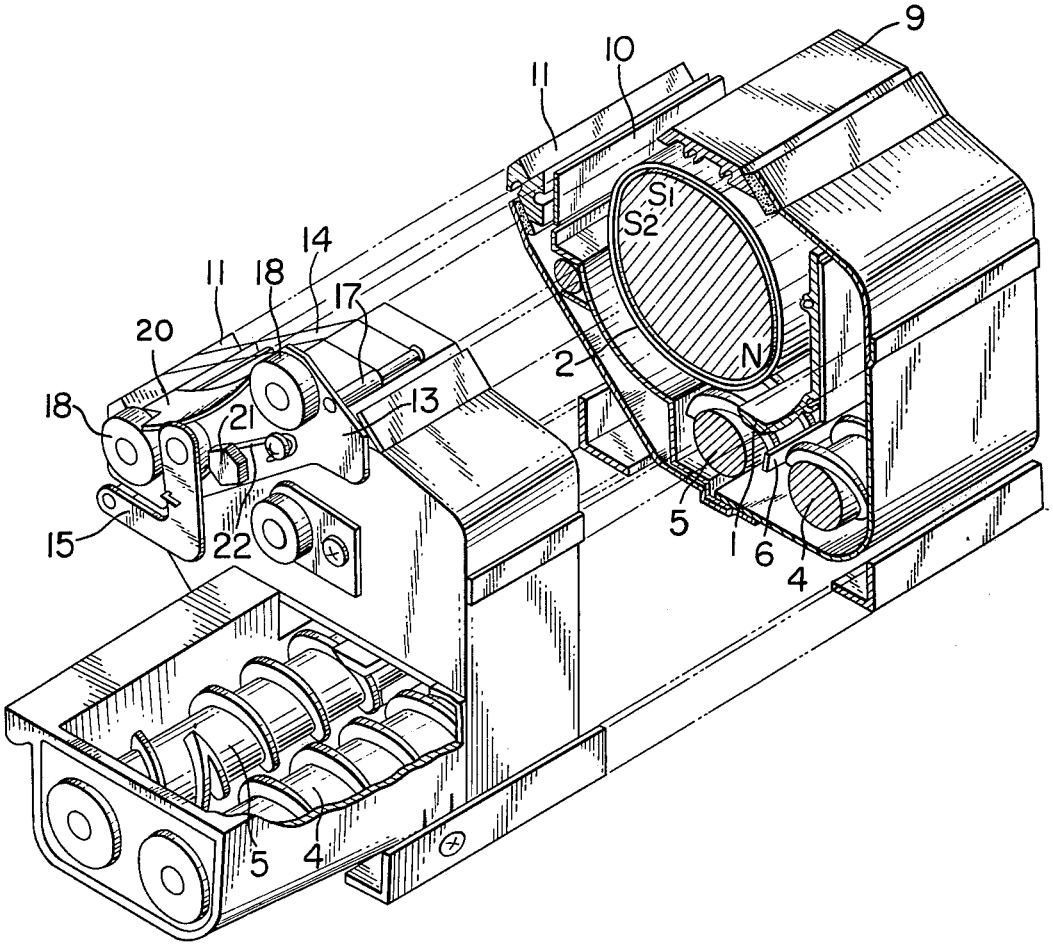
FIG. 4 is a perspective view of the entire developing device of FIG. 1 and showing the front and cross-section thereof.

At either end of the drum 12, as shown in FIG. 4, a sheet 14 is urged against the drum surface by the side plate 13 with elastic material 20 interposed therebetween. Thus, these members completely seal the developing zone at all sides thereof. The sheet 14 is formed of very thin but tough film (polyester film or the like), and has one end secured to a bar 17 and the other end tensioned by an arm 15; thus ensuring the intimate contact of the sheet with the surface of the drum 12. These are made integral with the dust-proof framework, and the mounting of the framework may be completed by hooking the cutaway portions of the side plates 13 on projections 21 so that the framework may be readily removable from the developing device.

A spring 22 then acts on the dust-proof framework to urge the same toward the surface of the drum 24 to thereby bring the four rollers 18 into intimate contact with the flanged portions of the drum at the opposite ends thereof, thus enabling the clearance within the afore-mentioned range, for example, to be secured between the drum surface and the stays. By so using the locating member which enables the framework to be readily removably mounted with respect to the photosensitive medium, the need to separate the dust-proof framework from the photosensitive drum surface may be eliminated in mounting or dismounting the photosensitive drum, and the mounting or dismounting of the framework itself for the purpose of maintenance or assembly may be done without imparting any damage to the photosensitive drum surface and, in addition, the predetermined slit clearance may be accurately maintained during the mounting. Further, even if an electrostatic latent image is present on the photosensitive drum surface, the sheet 14 may make it possible to provide a very sharp edge effect and render not only the end portions but also any desired portion of the developing zone sharply into a non-image-bearing area.

The function of the toner scatter preventing means will now be discussed. In the high-speed developing device, as shown in FIGS. 1 to 4, the air stream created by the rotation of the drum (in the shown embodiment, peripheral speed of 180 mm/sec.) and the rotation of the sleeve (in the shown embodiment, peripheral speed of 300 mm/sec.) is likely to cause scattering of the developing particles such as toner and carrier which are very slight in weight, and a similar problem also occurs in the conventional developing device wherein the scattering of the developing particles is caused by the air stream resulting from the movement of the photosensitive medium. In constrast, according to the present invention, this can effectively be eliminated by the above-described dust-proof means.

In the clearance portion formed by the upper stay 9, the air stream created by the adhesion of the air to the surface of the drum 12 contributes to a perfect dust-proof effect. In the clearance portion formed by the lower stays 10 and 11, a plurality of clearances can achieve a dust-proof effect. More specifically, a small quantity of scattered toner having passed through a first clearance (the clearance formed by the stay 10) while being entrained by a rapid air stream does not scatter outwardly but drops between the stays 10 and 11, because the speed of the air stream is sharply decreased and the air resistance increased as soon as the air has passed through the clearance. Should there by any toner entrained by the air stream adjacent the drum 12, the scattering of the toner may be completely prevented by an effect similar to that provided by the first clearance, which effect results from a plurality of clearances formed by the plurality of edges possessed by the stay 11.

Also, by increasing the number of stays 10 as required, a perfect dust-proof effect may be achieved during whatever high-speed rotation, and this is of very important significance to the usefulness of the present invention.

Figure 5:
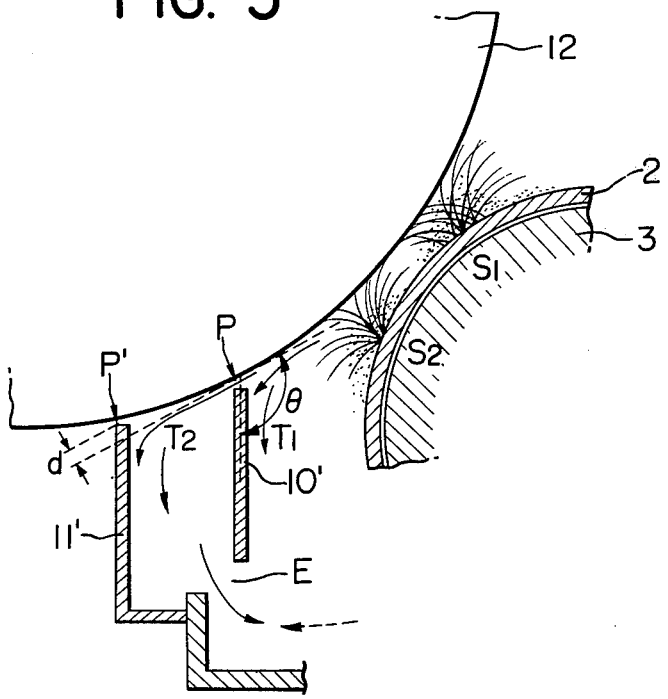
FIG. 5 is a simplified cross-sectional view of the FIG. 1 developing device for illustrating the principle of the scattered developing dust collection in the same device.

The foregoing function will further comprehensibly be explained on its principle by reference to FIG. 5.

In this figure, the photosensitive drum 12 and dust-proof plates 10',11' (corresponding to the lower stays 10, 11 in FIG. 1) are only schematically shown to facilitate the understanding. Designated by E is an outlet port between the dust-proof plates 10', and 11'. The air stream along the surface of the drum 12 resulting from the rotation of the drum and entraining toner dust is first blocked by the first dust-proof plate 10' and a majority of such toner dust flows away from the drum surface in the direction of arrow $T_1$ and to a lower portion of the developing device. As a result, only a very small quantity of the toner dust passes through the slit P between the first dust-proof plate 10' and the drum surface. The dust which has passed through such slit P tries to further advance with the air stream along the drum surface. However, if the second dust-proof plate 11' is provided which extends toward the drum by an excess amount d in the drawing beyond the tangent to the drum at the slit P, the toner dust in the slit P which tries to go outwardly of the tangent due to the centrifugal force of the toner dust resulting from the rotation of the drum 12 will strike against the dust-proof plate 11' and flow in the direction of arrow $T_2$, so that only a very much limited quantity of the toner dust will pass through the slit P' between the dust-proof plate 11' and the drum surface. The air stream and toner dust thus blocked by the second dust-proof plate 11' passes through the outlet port E back into the developer container. The requirement that the opening dimension of the outlet port E be greater than that of the slit P' will readily be understood. Further, the presence of the outward air stream at the outlet port serves to block a counter air stream (dotted line) containing toner dust of higher concentration which tries to enter through the outlet port E.

If the toner dust having likewise passed through the slit P' is of a substantially significant quantity, then a third, a fourth and further dust-proof plates may be provided as required, to prevent the scattering of such toner dust.

The angle at which the above-described dust-proof plates are mounted with respect to the surface of the photosensitive drum surface, namely, the angle $\theta$ formed by the center line of each dust plate with the tangent to the drum in the slit portion may desirably be an obtuse angle ($\theta > \pi/2$).This will be useful to keep more of the air stream away from the slit. It will also be appreciated from a simple calculation that the opening dimensions of the slits selected to such a relation that slit P> slit P'> . . . are preferable to prevent the back flow of the air stream in the outlet port E.

Also, the dust-proof effect may be enhanced by applying a voltage to the dust-proof plates or applying voltages of different polarities to the adjacent dust-proof plates 10',11' and so on. Deposition of the collected toner dust on the dust-proof plates may be prevented by coating the surfaces of the dust-proof plates with a low surface tension substance such as, for example, fluororesin.

The mechanism employing the multistage dust-proof plate may also be disposed above the developing device housing, namely, at the entrance side thereof. Since the entrance side is usually the air inlet side, such a multi-stage arrangement is not always necessary but, as in the shown embodiment, it is desirable to use a design like that of the upper stay 9 which reduces the clearance to maintain the quantity of air at a minumum so that the quantity of air flowing out of the lower stay portion or the exit side may be reduced, thereby reducing the quantity of scattered toner dust.

Figure 6:
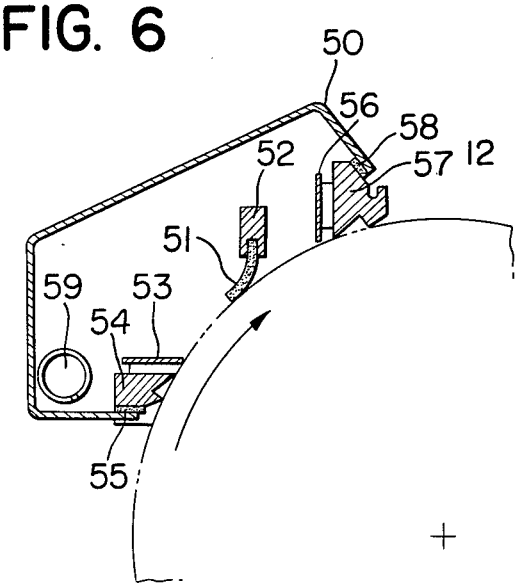
FIG. 6 is a cross-sectional view of an embodiment of the developer treating device according to the present invention as applied to a cleaning device for cleaning the photosensitive medium after image development and transfer.

FIG. 6 shows another embodiment of the developer treating device according to the present invention as applied to the cleaning device which is another process means in an electrophotographic copying apparatus. This cleaning device itself is conventional and well-known and is directed to the removal of the developer remaining on the photosensitive drum surface to make such developer available for reuse. In the figure, as an example of the cleaning means, a cleaning blade 51 formed of resilient material is disposed with one end thereof secured by a holder 52 and the other end in frictional contact with the surface of the photosensitive drum 12. A housing 50 for covering the cleaning means is provided in such a relationship that it is mounted and dismounted with the cleaning means with respect to the photosensitive drum 12. In the upper and lower open end portions of the housing, dust-proof plates for preventing the scattering of the developer are disposed along the surface of the photosensitive drum. These dust-proof plates comprise upper stays 56, 57 and lower stays 53, 54, and are attached to the housing 50 with elastic members 58, 55 interposed therebetween. The constructions and functions of these stays are similar to what has already been described with respect to the embodiment as applied to the developing device, and need not be described. Designated by 59 is a screw by which the developer removed from the photosensitive drum surface may be conveyed from within the housing 50 back into the developing device housing.

The cleaning means will not be restricted to the shown blade cleaning member if some well-known conventional means other than that shown is disposed so as to be adapted for the cleaning function.

The hitherto-described compact dust-proof framework eliminating any rotating or otherwise moving member and having a dust-proof effect and provided with various film-like seal members of resilient material susceptible to damages is readily removable from the body of the developing device. This is advantageous for the purpose of maintenance, for example, replacement of the developer and, in addition, satisfies the requirements especially involved in the assembly and keeping of the device.

The present invention eliminates the use of numerous members such as a suction blower, filter, and accessory dust hose, etc., thus enabling a smaller size for the entire copying machine.

Further, the non-contact seal means of the present invention is not limited in use to dry developing devices but may be effectively applied in any and every device that requires non-contact sealing, such as wet developing devices, cleaning devices, etc.

What is claimed is:

1. In apparatus of the type having means for developing latent images with a powder form developer, the combination comprising:

a movable member having a latent image bearing surface;

developer means including a housing for holding a supply of powder developer, said developer means being disposed adjacent said image bearing surface for applying powder developer to said surface;

means for driving said movable member past said developer means; and powder scatter sealing means disposed on said housing at a location adjacent to said image bearing surface for preventing said powder developer from escaping out from said housing, said sealing means including means operative to direct an air stream into said housing, wherein said air stream is produced by said movement of said image bearing surface, and wherein said sealing means further includes at least one air stream limiting means disposed closely adjacent said surface, and at least one air stream expanding means disposed adjacent to said limiting means.

2. In apparatus of the type having means for developing latent images with a powder form developer, the combination comprising:

a movable member having a latent image bearing surface to which powder developer is applied;

means for driving said movable member;

developer handling means including a housing disposed adjacent said surface, and means for transporting powder developer within said housing; and powder scatter sealing means disposed on said housing at a location adjacent to said surface for preventing said powder developer from escaping out from said housing, said sealing means including means within said housing operative to direct an air stream away from said image bearing surface in said housing, wherein said air stream is produced in said housing by the movement of said surface.

3. Apparatus according to claim 2, wherein said developer handling means comprises developing means for developing the latent image formed on the image bearing surface.

4. Apparatus according to claim 2, wherein said developer handling means comprises cleaning means for removing residual developer applied to the image bearing surface.

5. Apparatus according to claim 2, wherein said sealing means includes at least one means disposed closely adjacent said surface for limiting said air stream, and at least one means for expanding said air stream, said expanding means being disposed downstream of said limiting means in the direction of movement of said surface and extending substantially perpendicularly to the direction of said movement and wherein said flow limiting means and said flow expanding means include a wall member extending toward said surface at an angle of more than $\pi/2$ radians measured from the upstream side with respect to the movement of said surface.

6. Apparatus according to claim 2, wherein said sealing means is disposed at a predetermined clearance in the range of 0.05 to 0.6 mm, with respect to said surface.

7. In apparatus of the type having means for developing latent images with a powder form developer, the combination comprising:

a movable member having a latent image bearing surface to which the developer is applied;

means for driving said movable member;

developer handling means for transporting powder developer in the vicinity of the surface of the movable member, wherein said developer handling means includes a housing disposed adjacent said surface; and powder scatter sealing means movably mounted on said housing for being disposed adjacent said image bearing surface to prevent said powder developer from escaping out from said housing, said sealing means including means operative to direct an air stream in the vicinity of said surface into said housing wherein said air stream is produced by said movement of said surface, said sealing means being selectively movable between a first position in operative relationship to said surface, and a second position spaced from said surface wherein said housing may be freely attached to and removed from said apparatus.

8. Apparatus according to claim 7, further comprising means disposed on said sealing means for resiliently urging said sealing means toward said first position, and a spacer member for maintaining a predetermined minimum clearance between said surface and said sealing means irrespective of the relative movement between said housing and said surface.

9. Apparatus according to claim 7, wherein said sealing means includes at least one means disposed closely adjacent said surface for limiting said air stream, and at least one means for expanding said air stream, said expanding means being located adjacent to said limiting means.

10. In apparatus of the type having means for developing latent images with a powder form developer, the combination comprising a rotatable drum member having a latent image bearing surface to which powder developer is applied;

means for driving said rotatable drum;

developer handling means for transporting powder developer in a housing which is disposed adjacent said surface; and powder scatter sealing means disposed on said developer handling means at a location adjacent to said surface for preventing said powder developer from escaping out from said developer handling means, wherein said sealing means is disposed downstream with respect to an air stream which contains scattered powder and which is caused in said housing by rotation of said image bearing member, said sealing means including at least a first portion for defining a small clearance and a second portion, downstream of said first portion with respect to the air stream, for defining a space adjacent to said first portion.

11. Apparatus according to claim 10, wherein said developer handling means comprises developing means for developing a latent image formed on the image bearing member surface, a magnet member and a non-magnetizable member movable relative thereto, and wherein said powder scatter sealing means is located at a downstream portion of a developing position of said developing means with respect to transportation of the developer.

12. In apparatus of the type having means for developing latent images with a powder form developer, the combination comprising:

a movable member having a latent image bearing surface;

developer means including a housing for holding a supply of powder developer, said developer means being disposed adjacent said image bearing surface for applying powder developer to said surface;

means for driving said movable member past said developer means; and powder scatter sealing means disposed on said housing at a location adjacent to said image bearing surface for preventing said powder developer from escaping out from said housing, said sealing means including means operative to direct an air stream into said housing, wherein said air stream is produced by operation of said developer handling means, and wherein said sealing means further includes at least one air stream limiting means disposed closely adjacent said surface, and at least one air stream expanding means disposed adjacent to said limiting means.

13. In apparatus of the type having means for developing latent images with a powder form developer, the combination comprising:

a movable member having a latent image bearing surface to which the developer is applied;

means for driving said movable member;

developer handling means for transporting powder developer in the vicinity of the surface of the movable member, wherein said developer handling means includes a housing disposed adjacent said surface; and powder scatter sealing means movably mounted on said housing for being disposed adjacent said image bearing surface to prevent said powder developer from escaping out from said housing, said sealing means including means operative to direct an air stream in the vicinity of said surface into said housing wherein said air stream is produced by operation of said developer handling means, said sealing means being selectively movable between a first position in operative relationship to said surface, and a second position spaced from said surface wherein said housing may be freely attached to and removed from said apparatus.

14. In apparatus of the type having means for developing latent images with a powder form developer, the combination comprising a rotatable drum member having a latent image bearing surface to which powder developer is applied;

means for driving said rotatable drum;

developer handling means for transporting powder developer in a housing which is disposed adjacent said surface; and powder scatter sealing means disposed on said developer handling means at a location adjacent to said surface for preventing said powder developer from escaping out from said developer handling means, wherein said sealing means is disposed downstream with respect to an air stream which contains scattered powder and which is caused in said housing by operation of said developer handling means, said sealing means including at least a first portion for defining a small clearance and a second portion, downstream of said first portion with respect to the air stream, for defining a space adjacent to said first portion.

* * * * *